US007024704B2

(12) United States Patent
Gafforio et al.

(10) Patent No.: US 7,024,704 B2
(45) Date of Patent: Apr. 11, 2006

(54) DEVICE FOR UNLOCKING THE ROTATION OF A CRASH-HELMET CHIN GUARD

(75) Inventors: Luca Gafforio, Comun Nuovo (IT); Alberto Salvetti, Bergamo (IT); Gabriele Tomasoni, Bariano (IT)

(73) Assignee: OPTICOS S.r.l., Brembate di Sopra (IT)

( * ) Notice: Subject to any disclaimer, the term of this patent is extended or adjusted under 35 U.S.C. 154(b) by 86 days.

(21) Appl. No.: 10/873,762

(22) Filed: Jun. 23, 2004

(65) Prior Publication Data

US 2005/0015861 A1 Jan. 27, 2005

(30) Foreign Application Priority Data

Jul. 25, 2003 (EP) ..... 03425497

(51) Int. Cl.
*A42B 1/08* (2006.01)

(52) U.S. Cl. ..... 2/424

(58) Field of Classification Search ..... 2/424, 2/6.3, 6.5

See application file for complete search history.

(56) References Cited

U.S. PATENT DOCUMENTS

| | | | | |
|---|---|---|---|---|
| 5,813,048 | A * | 9/1998 | Thom | 2/6.5 |
| 6,212,689 | B1 * | 4/2001 | Lee | 2/424 |
| 6,226,803 | B1 * | 5/2001 | Tanaka | 2/424 |
| 6,249,918 | B1 | 6/2001 | Lacroix | |
| 2003/0182716 | A1 * | 10/2003 | Wu | 2/424 |
| 2005/0015861 | A1 * | 1/2005 | Gafforio et al. | 2/424 |

FOREIGN PATENT DOCUMENTS

| | | |
|---|---|---|
| EP | 0 638 253 | 2/1995 |
| EP | 0 895 726 | 2/1999 |
| EP | 1 183 957 | 3/2002 |

* cited by examiner

*Primary Examiner*—Rodney M. Lindsey
(74) *Attorney, Agent, or Firm*—Nixon & Vanderhye P.C.

(57) ABSTRACT

A releasing device for enabling rotation of a chin guard hinged to the sides of the cap of a crash helmet, in particular a helmet for motor-cyclists, which comprises at least one mechanism for engagement/release of the chin guard with respect to the cap, first means for actuation of the engagement/release mechanism and second means for inhibition of release, in which said first and second means can be actuated by the user. The aforesaid second means for inhibition of release prevent, when not actuated by the user, operation of the first actuation means and/or of the engagement/release mechanism.

20 Claims, 5 Drawing Sheets

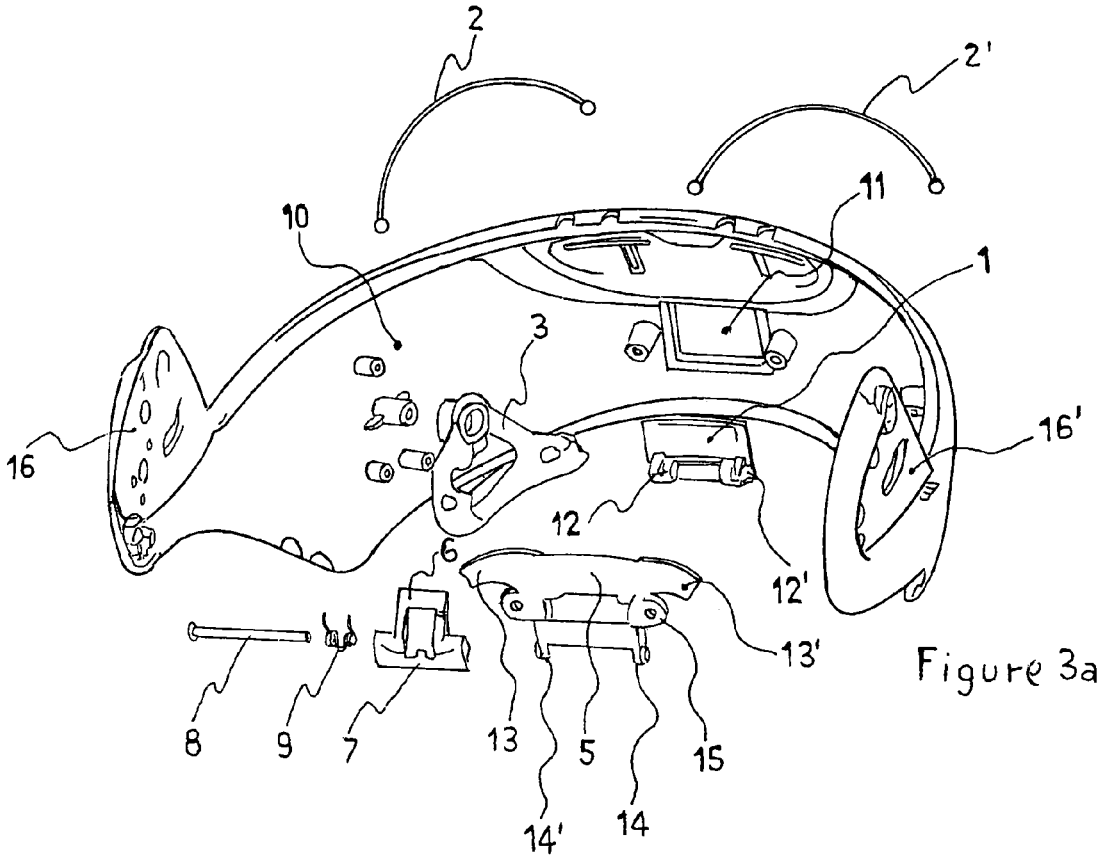
Figure 3a
Figure 4
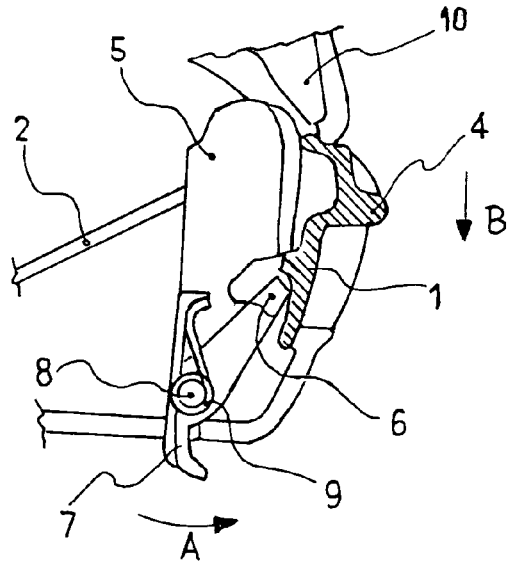

DEVICE FOR UNLOCKING THE ROTATION OF A CRASH-HELMET CHIN GUARD

This application claims priority to EP Application No. 03425497.9, filed Jul. 25, 2003. The entire contents of this application is incorporated herein by reference.

The present invention relates to a releasing device for enabling rotation of a chin guard (i.e. to a device for unhooking the rotation of a crash-helmet chin guard) hinged to the sides of the cap of a crash helmet, in particular for motor-cyclists, of the type which comprises at least one mechanism for engagement/release of the chin guard with respect to the cap and means for actuation of the engagement/release mechanism having at least one control element which can be actuated by the user.

A known technique is to equip crash helmets for motor-cyclists with a portion for protecting the chin of the user, also referred to as chin guard, which is made separately from the cap designed to protect the motor-cyclist's head and is pivoted to said cap on the lateral surfaces of the latter. This solution likewise envisages that the chin guard may be rotated from a raised position, in which the chin guard is set above the window of the helmet (in which the visor is present) to a lowered position, in which the chin guard is set in a position corresponding to the chin and the mouth of the user.

In the latter position, the chin guard is withheld against the cap by one or more engagement/release mechanisms, so that the helmet may be likened, to all effects, to the type of helmet commonly defined as integral. As compared to the latter type, in which the chin guard cannot be tilted back with respect to the cap, helmets with chin guards that can be tilted back offer considerable advantages for the motor-cyclist as regards putting on and taking off the helmet and as regards putting on and taking off his goggles, and furthermore, in the case of stops, this type of helmet enables the motor-cyclist to have a greater degree of freedom, without him having to remove the helmet from his head.

The engagement/release mechanism is consequently in this case designed to prevent, in a non-permanent way, relative rotation of the chin guard with respect to the cap and thus to prevent any accidental impact, or the flow of air that impinges on the helmet during motion, or any improper use of the helmet from causing undesirable lifting of the chin guard itself.

The engagement/release mechanism usually comprises at least one pawl (or hook), which is fixed to the chin guard and is removably engageable with a corresponding seat (or pin) made on the cap (or vice versa) and is operatively connected to manual actuation means, which enable the user to release the pawl from its seat and thus to rotate and raise the chin guard.

Known to the art are crash helmets provided with raisable chin guards, in which two engagement and release devices of the type referred to above are set laterally on the chin guard, and each of them is equipped with a lever (or alternatively with a slider or a push-button) for manual actuation, designed to disengage the pawl from the corresponding seat. In order to be able to release the chin guard from the cap, the user must therefore act simultaneously on both of the levers (or sliders or push-buttons) for manual actuation and then rotate the chin guard.

The above solution forces the motor-cyclist to use both hands simultaneously and consequently, whilst rendering rather difficult any accidental release of the chin guard itself, involves a certain difficulty of actuation.

Recent embodiments of crash helmets equipped with raisable chin guards envisage two engagement/release mechanisms set symmetrically on the side walls of the chin guard, as well as means for actuation of the engagement/release mechanism consisting of just one mobile control element, which, when actuated by the user, is able to release both of the pawls from the corresponding seats simultaneously.

In particular, the mobile control element may be a slider, a push-button, or a lever, which, being mounted in a translatable way on the chin guard, has an outer region, on which the user may exert an appropriate force of translation, or rotation, and an inner region shaped for constraining one or more tie rods, which are operatively connected to the engagement/release mechanisms. The slider is in this case translatable between an inoperative position with respect to the engagement/release mechanisms and a position for actuation of the tie rods, which causes release of the chin guard from the cap.

A releasing (unlocking) device of the type referred to above is, for example, described in the German patent application DE-A-4040172, filed in the name of BMW, and in the European patent application EP-A-0518178, which is also filed in the name of BMW.

The above releasing devices equipped with a single actuating slider or push-button, albeit undoubtedly effective and simple to use, are, however, subject to considerable limits as regards their reliability of use and sometimes may induce the motor-cyclist to resort to improper manoeuvring of the system for actuation of the engagement/release mechanisms.

In fact, the presence of just one element for actuation of the engagement/release mechanisms makes it particularly simple for the user to actuate the releasing device with just one hand even when the vehicle is moving, and may likewise not prevent involuntary release of the chin guard by the user, when the latter is performing the normal operations of opening the visor or the ventilation devices present on the helmet chin guard itself.

With a view to increasing safety of use of said devices, the patent application EP-A-0972461 (in the name of SHOEI) proposes mounting the slider for actuation of the engagement/release mechanisms on the chin guard so that the direction and the sense of translation of the slider will be different from and opposite to those for raising the chin guard.

The above solution, albeit rendering difficult any undesirable or involuntary raising of the chin guard, is unable to prevent accidental rotation of the chin guard effectively when the slider undergoes impact in its direction of translation. It is in fact sufficient that, in the instant in which the slider is accidentally displaced in its actuation position, the helmet is subjected to oscillations or impact acting in a direction different from that of translation of the slider, to cause raising of the chin guard.

Furthermore, it is always possible that the user may involuntarily displace the slider connected to the engagement/release mechanisms during while the motor vehicle is in motion and then impose an albeit limited rotation on the chin guard which can set the hooks or pawls out of line with respect to the pins or seats and prevent, upon release of the slider, the engagement/release mechanisms from returning to the position where they withhold the chin guard itself, with the consequent risk of a subsequent accidental opening of the chin guard.

It is consequently a purpose of the present invention to provide a releasing device for enabling rotation of a chin guard hinged to the sides of the cap of a crash helmet, in particular for motor-cyclists, which will not present the drawbacks of the known art, and one which will reduce as far as possible the risk of the user performing involuntary manoeuvres that might cause any accidental rotation of the chin guard itself with respect to the cap of the helmet. Such a solution will thus ensure considerable safety of use.

Yet another purpose of the present invention is to provide a releasing device for enabling rotation of a chin guard hinged to the sides of the cap of a crash helmet, in particular for motor-cyclists, distinguished by presenting a high ergonomic level and a high degree of reliability and by being easy to make and inexpensive to manufacture.

A further purpose of the present invention is to provide a crash helmet for motor-cyclists which, having a device for releasing a chin guard hinged to the sides of the cap, will be practical and simple to use in those situations in which, with the vehicle stationary, the chin guard has to be opened with just one hand, i.e., without having to (or without being able to) act simultaneously on the engagement/release mechanisms with both hands, as for example in the case of a stop for refuelling at a service station, a motorway toll-gate, traffic lights, etc.

Another purpose of the present invention is to propose a method for the use of a crash helmet provided with raisable chin guard which will prevent the user from performing involuntary manoeuvres such as might cause accidental or dangerous rotations of the chin guard itself with respect to the cap of the helmet.

These and other purposes are achieved by the releasing device for enabling rotation of a chin guard hinged to the sides of the cap of a crash helmet according to the first independent claim and the subsequent dependent claims, by the helmet according to Claim 18, and by the method for releasing and enabling rotation of a chin guard hinged to the sides of the cap of a crash helmet according to the independent Claim 19.

According to the present invention, the releasing device for enabling rotation of a chin guard hinged to the sides of the cap of a crash helmet, in particular for motor-cyclists, comprises at least one mechanism for engagement/release of the chin guard with respect to the cap, first means for actuation of the engagement/release mechanism, and second means for inhibition of release, in which said first and second means can be actuated by the user. The aforesaid second means for inhibition of release prevent, when not actuated by the user, operation of the first actuation means and/or of the engagement/release mechanism.

Consequently, the solution claimed not only forces the user to act simultaneously on two separate control means to obtain release and enabling of rotation of the chin guard, but also imposes on the user the need to actuate said separate control means according to a pre-defined sequence; i.e., said solution envisages that the user will first set in operation auxiliary means of inhibition designed to enable subsequent operation of the means for actuating the device for releasing the chin guard from the cap, and will then act on the aforesaid actuation means, keeping the inhibition means simultaneously actuated so as to be able to raise the chin guard.

The above procedure substantially prevents involuntary actuation of the releasing device, for example on account of erroneous operation of just the first actuation means during execution of the normal manoeuvres for opening the visor and/or the front ventilation devices, or else on account of an accidental impact; in this way, any risk of accidental raising of the chin guard by the user is reduced, which is particularly important when the vehicle is moving.

According to a particularly advantageous aspect of the present invention, the aforesaid first actuation means comprise at least one control element, which can move between a position for actuation of the engagement/release mechanism and an inoperative position as regards the engagement/release mechanism, and the second inhibition means prevent, for example by contrast of parts, when not actuated by the user, any displacement of the control element from the inoperative position to the position for actuation of the engagement/release mechanism.

In this way, both the actuation means and the inhibition means can be mounted, for example, on the chin guard, and the engagement/release mechanisms can be set in operation to obtain release of the chin guard, by means of the steps of actuation of the inhibition means, with the purpose of releasing the actuation means, and of subsequently triggering the actuation means, for enabling rotation of the chin guard.

According to a particular feature of the present invention, the releasing device for enabling rotation of the chin guard is provided with two devices for engagement/release of the chin guard with respect to the cap, which are set on opposite sides in positions corresponding to the sides of the cap, and with a single control element, preferably a slider, designed for actuating both of the engagement/release mechanisms. In this case, the means for inhibition of release comprise at least one removable arrest, which engages, by interposition of parts, with the control element and which can move between a position of engagement with the control element and a position of disengagement from the latter.

According to a further aspect of the present invention, there is provided a crash helmet for motor-cyclists, equipped with the releasing device for enabling rotation of the chin guard referred to above, in which for release of the chin guard it is necessary first to actuate the second inhibition means for enabling operation of the first actuation means and/or of the engagement/release mechanism, and then to actuate the first means for operation of the engagement/release mechanism.

In what follows, there will be illustrated two preferential embodiments of the present invention, which are provided purely by way of non-limiting example, with reference to the attached figures, in which.

Figure 1:
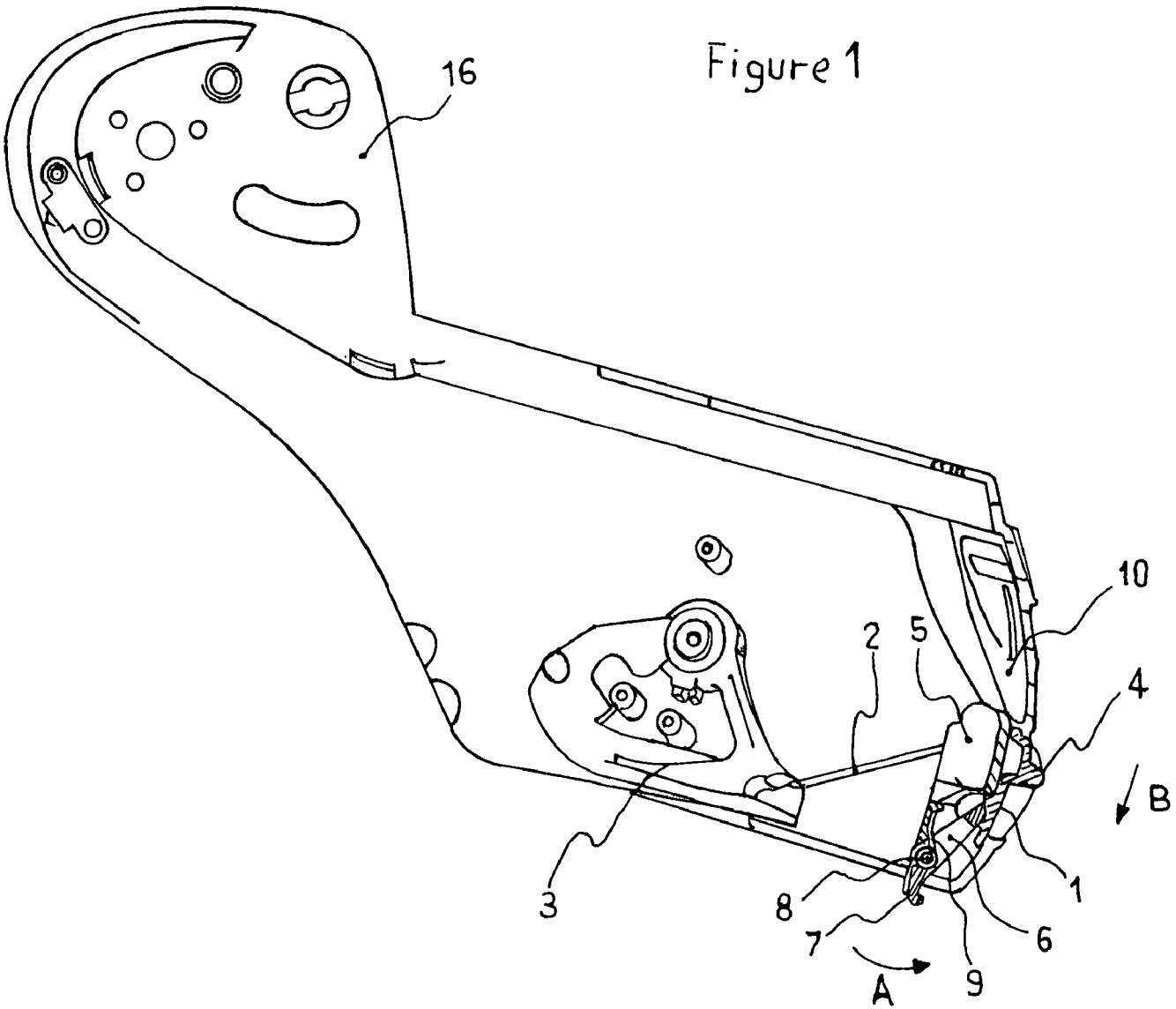
FIG. 1 is a cross-sectional view of a raisable chin guard of a crash helmet for motor-cyclists, equipped with a device according to a particular aspect of the present invention, in which the engagement/release mechanism of the chin guard is not withheld by the actuation means.
Figure 2:
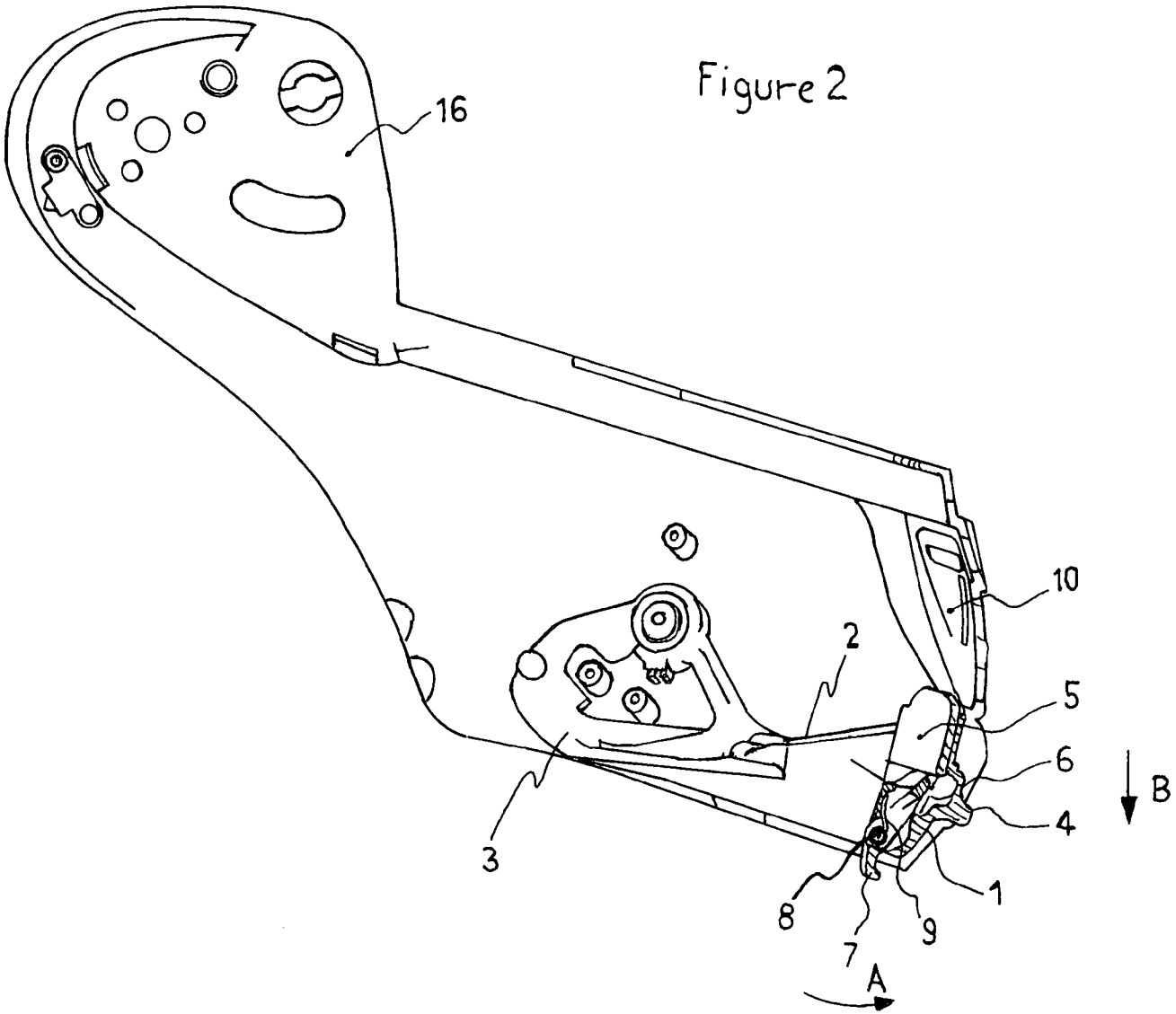
FIG. 2 is the same view of the chin guard of FIG. 1, in which, however, the engagement/release mechanism is withheld in the position of release by the actuation means.
Figure 3B:
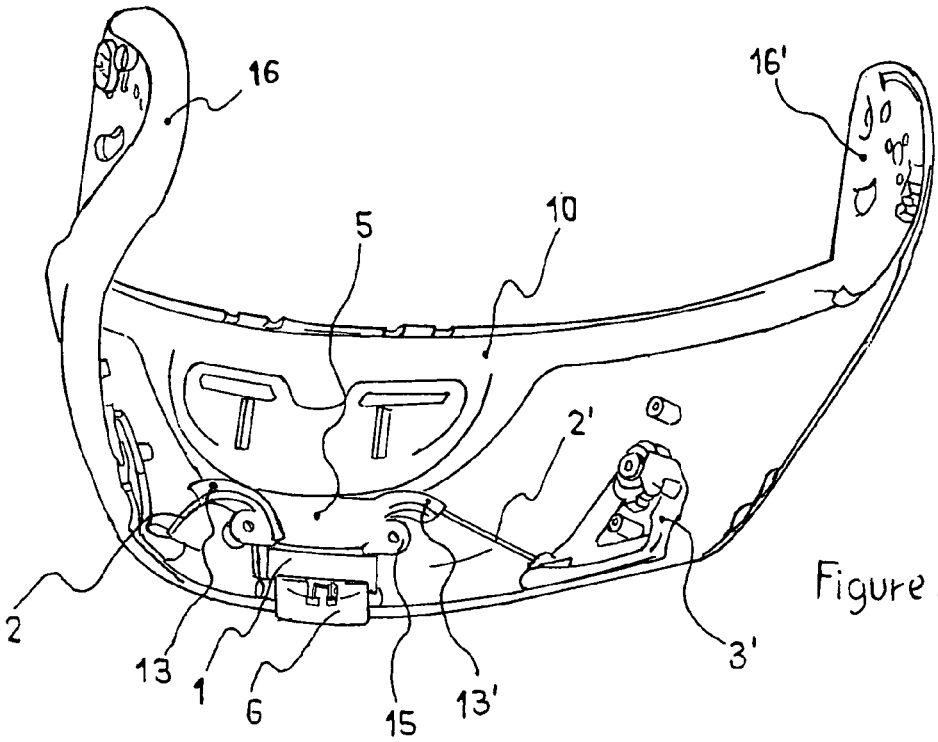
Figure 5:
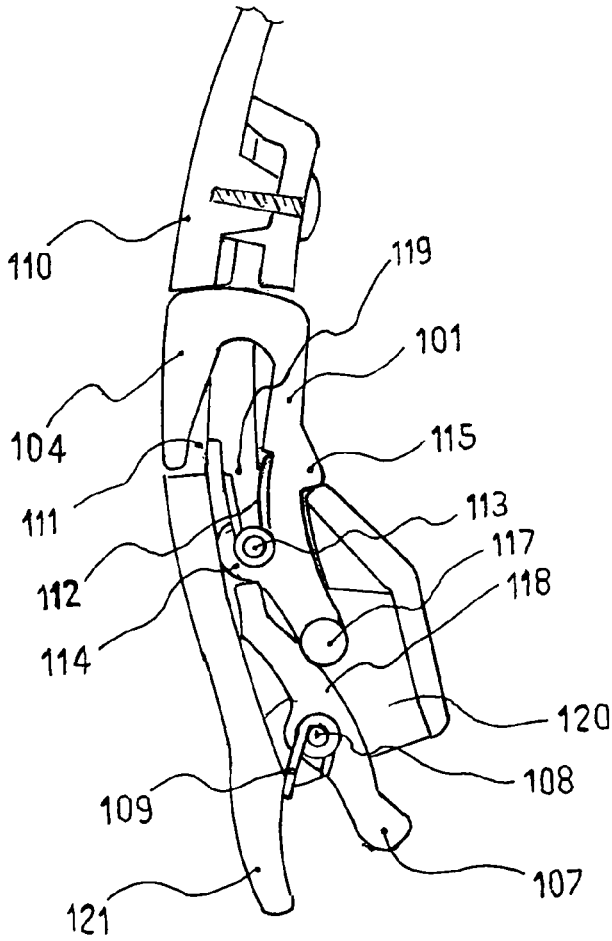
Figure 6:
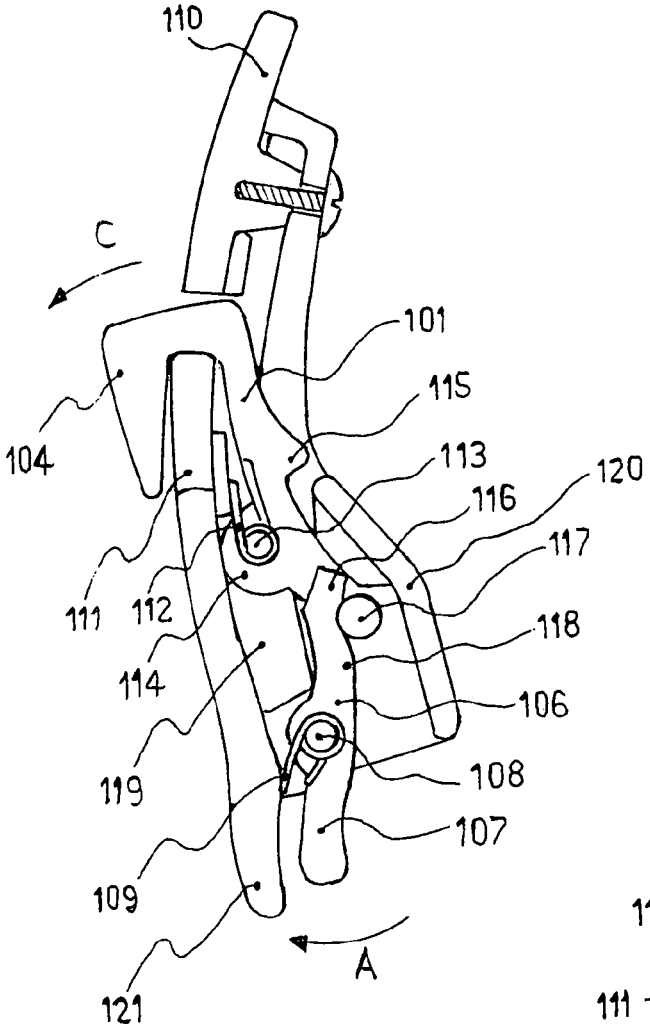
Figure 7:
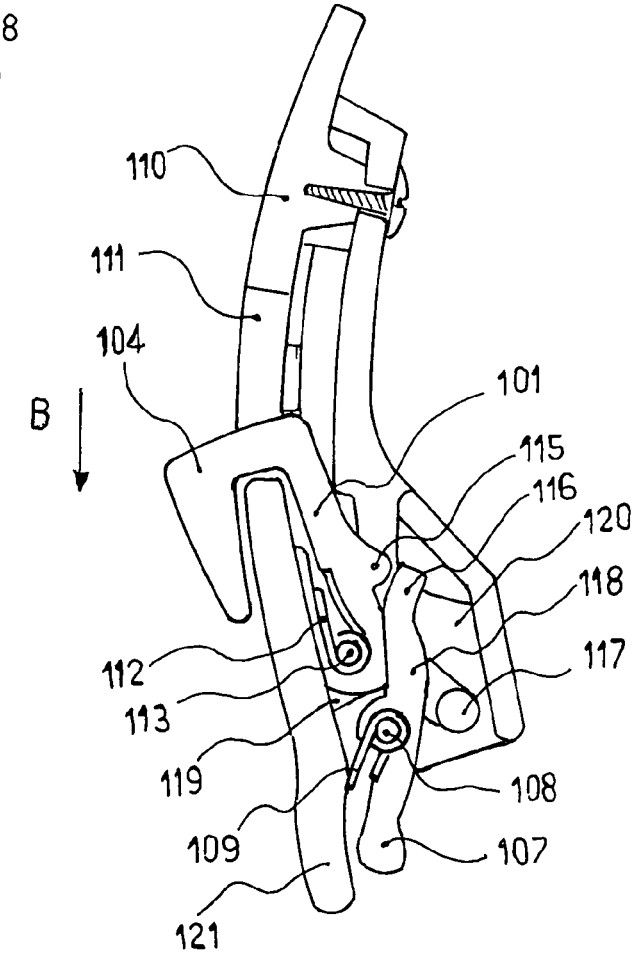

FIGS. 3*a* and 3*b* are two perspective views, one of which is exploded, of the chin guard and of the device of FIGS. 1 and 2;

FIG. 4 is an enlarged cross-sectional side view of the device of FIGS. 1 to 3*b*; and FIGS. 5 to 7 are partial cross-sectional views of a releasing device for enabling rotation according to a further aspect of the present invention, which illustrate various steps of actuation of the device for releasing the chin guard from the cap.

With reference to FIGS. 1, 2, 3*a*, 3*b* and 4, in a particular embodiment of the present invention, the releasing device for enabling rotation of a chin guard 10, which is hinged, in positions corresponding to the projections 16, 16', to the sides of the cap (not illustrated) of a crash helmet for motor-cyclists, comprises two engagement/release mechanisms 3, 3' of the chin guard to/from the cap, first actuation means 1, 5, 11, 2, 2' of the engagement/release mechanisms 3, 3', which can be actuated by the user, and second inhibition means 6, 7, 8 and 9 for preventing release of the chin guard, which can also be actuated by the user.

In the embodiment illustrated, when not actuated by the user, the means 6, 7, 8, 9 for inhibition of release of the chin guard 10 prevent, by contrast of parts, operation of the actuation means 1, 5, 11, 2, 2' and, at the same time (in embodiments not illustrated) said inhibition means 6, 7, 8, 9 may also prevent, for example by interposition of mechanical parts, operation of the engagement/release mechanisms 3, 3' by for instance not enabling their displacement.

In particular, in the embodiment of FIGS. 1 to 3*b*, each of the engagement/release mechanisms of the chin guard 10 to/from the cap comprises, according to a known technique, a rotatable pawl 3, 3', which is hinged to the chin guard 10 itself along one of its internal side walls and is designed to engage with a corresponding seat, or pin, provided in a position corresponding to a side of the cap. The pawls 3, 3' are operatively connected to the means for actuation of the engagement/release mechanisms by means of the tie rods 2, 2', which extend between a control element 1, which can be actuated by the user, and the pawls 3, 3' themselves.

The tie rods 2, 2' perform the function of transmitting the motion exerted by the user on the control element 1 onto the rotatable pawls 3, 3' so as to impose on the latter a rotation which will be able to disengage the pawls 3, 3' themselves from the corresponding seats of the cap in order to enable raising of the chin guard 10.

In alternative embodiments (not illustrated), said tie rods 2, 2' may be replaced by a single tie rod (as, for example, described in the patent DE-A-4040172) or by any other kinematic chain capable of transmitting the motion imposed by the user on the control element 1 for controlling the actuation means to the engagement/release mechanisms, when this transmission of motion is not prevented by the aforesaid inhibition means 6, 7, 8 and 9, with the purpose of enabling disengagement of the chin guard 10 from the cap.

The means for actuation of the device, represented in FIGS. 1 to 4, comprise, in greater detail, a slider 1 mounted slidably, so that it can move according to the direction indicated by the arrow B, within a guide window 11 made on a central portion of the chin guard 10, and a fixed structure 5, which is also constrained to the chin guard 10 by means of rivets or screws that are housed within seats 15, and is equipped with two guide portions 13, 13', on which there are slidably constrained two tie rods 2, 2', connected to the pawls 3, 3'.

The slider 1 comprises two fastener (claw) elements 12, 12' (which can be seen in FIG. 3*a*), designed to withhold one end of the two tie rods 2, 2', and a projection 4, which protrudes outside the chin guard 10 and on which the user may exert a force of translation for the slider 1 itself, directed according to the arrow B. The slider 1, when not withheld by the aforesaid inhibition means 6, 7, 8, 9, is thus able to move between an inoperative position (FIG. 1) with respect to the engagement/release mechanisms, in which the tie rods 2, 2' do not act on the pawls 3, 3', and an actuation position (FIG. 2) of said devices, in which the tie rods 2, 2' withhold said pawls 3, 3' in a position shifted away from the corresponding seats, or pins, of the cap.

The actuation means described above may also comprise elastic means (not illustrated in the figures), designed to withhold the rotatable pawls 3, 3' in a position of engagement with the seats of the cap. The aforesaid elastic means, via the tie rods 2, 2', may induce the slider 1 to remain in its aforesaid inoperative position and may oblige the user to overcome the force exerted by them in order to displace the slider 1 itself.

The external surface of the chin guard 10, at the sides of the guide window 11 in which the slider 1 slides, moreover has surrounding structures for protecting the projection 4 so that it can be actuated only if the user voluntarily exerts the force B at a point corresponding to the projection 4 itself, and not as a result, for example, of involuntary impact or other manoeuvres of actuation of the visor or of the systems of ventilation normally located on the chin guard.

The means for inhibiting release that are present in the device of FIGS. 1 to 4 comprise an arrest 6 assembled on the chin guard 10 so that it can move between a position of engagement, by contrast of parts, with the slider 1 (visible in FIG. 1) and a position of disengagement from said slider 1 (visible in FIG. 2). The arrest 6 coincides, in the particular embodiment of the device according to the present invention described herein, with one of the arms of a two-armed safety lever 6, 7, which is constrained elastically in rotation to the support 5 by means of a pin 8 and a retention spring 9. The support 5 is accordingly provided with a seat 14, 14' for the pin 8 and is rendered fixed to the chin guard itself 10 by threaded means, which engage in the holes 15.

The retention spring 9, in the absence of external forces, pushes the arrest 6 into engagement with the slider 1, so preventing any translation of the latter in the sense indicated by the arrow B.

The other arm 7 of the two-armed lever projects from a central bottom portion of the chin guard 10 and enables the user to control rotation, in the direction and sense indicated by the arrow A, of the lever 6, 7 about the pin 8, by overcoming the resistance exerted by the spring 9, in order to displace the arrest 6 from its position of engagement with the slider 1.

When the user wishes to raise the chin guard 10 with respect to the cap of the crash helmet, starting from the situation illustrated in FIG. 1, in which the chin guard 10 is lowered and is withheld by the devices 3, 3', he must act first on the lever 6, 7, pushing the arm 7 in the sense indicated by the arrow A, to counteract the force exerted by the spring 9 so as to disengage the arrest 6 from the slider 1.

Then, keeping the lever 6, 7 rotated and acting on the projection 4, the user must impose on the slider 1, which is now free to displace within the guide defined by the window 11 and by the support 5, a translation in the sense indicated by the arrow B, which is able to actuate the tie rods 2, 2' and, in this way, to cause rotation of the pawls 3, 3' and their consequent disengagement from the corresponding seats or pins of the cap (see FIG. 2). At this point, the user can rotate the chin guard 10, by acting directly on the latter, into a raised position with respect to the cap. The displacements A and B, in the aforesaid correct succession, may for example be performed, respectively, with the thumb and forefinger of just one hand; the consequent release of the chin guard and the rotation of opening thereof are consequently simple, practical and ergonomic.

The lever 6, 7, which is pivoted elastically to the support 5 thanks to the pin 8 and to the spring 9, consequently forces the user who wishes to open the chin guard 10, firstly to actuate the lever 6, 7, and next to actuate the slider 1, and only then, with these two prior actions maintained simultaneously operative, is it possible for him to start rotating the chin guard with respect to the cap.

Likewise, said lever 6, 7, which, together with the pin 8 and the spring 9, constitutes the aforesaid means for inhibition of release, substantially behaves as a safety lever since it is unlikely that the aforesaid sequence may arise by accident.

In one embodiment (not illustrated), with the purpose of increasing the reliability of the device according to the present invention, in accordance with a known technique, the engagement/release mechanisms, and in particular the pawls 3, 3' of FIGS. 1, 2, 3*a* and 3*b*, may be equipped with individual actuation means (such as, for example, levers, push-buttons or sliders), which enable the user to disengage said pawls 3, 3' from the corresponding seats present on the cap of the helmet in a mutually separate way and in a way independent of the actuation of the device according to the present invention. In this way, in the case of possible malfunctioning or jamming of the device for releasing the chin guard, the user is always able to release the chin guard 10 with respect to the cap by acting simultaneously on the individual means for actuation of the engagement/release mechanisms 3, 3'. With reference now to FIGS. 5 to 7, described in what follows is a further embodiment of the present invention, in which the slider for actuation of the tie rods is set in, in its inoperative position, with respect to the engagement/release mechanisms, flush with the outer surface of the chin guard, and therefore requires, for its displacement by the user, a prior rotation, which will enable its extraction.

More in particular, the releasing device for enabling rotation of a chin guard 110 hinged to the sides of the cap of a crash helmet for motor-cyclists, illustrated in FIGS. 5 to 7, comprises at least one device (not shown) for engaging/releasing the chin guard 110 with respect to the cap of the helmet, means for actuation of said device equipped with a slider 101, which is constrained in a slidable and rotatable way to the chin guard 110 itself, and inhibition means, which have a two-armed safety lever 106, which acts by contrast of parts on the slider 101.

The slider 101 comprises: an actuation portion 104, which is built-in, in a resting position of the slider 101 itself, within an opening 111 made frontally on the chin guard 110; a front projection 114, which rests on the safety lever 106, a rear projection 115, which rests on of a support 120; and an end region, which has the conformation of a cam or a pin 117 for engagement with the aforesaid lever 106.

The slider 101 is moreover mounted in a rotatable way by means of a pin 113, which is inserted in a hole made in the aforesaid front projection 114, on a slide 119, which is in turn slidably mounted within a fixed structure, or support, 120 constrained to the chin guard 110 by means of screws or rivets, which are housed in appropriate seats made on the support 120 itself.

Said slide 119, and consequently the slider 101, is also operatively connected to the engagement/release mechanism, for example by means of one or more tie rods (not illustrated) so that its translation in the direction and sense indicated by the arrow B will bring about disengagement of the chin guard 110 from the cap of the crash helmet.

A spring 112, set between the slider 101 and the slide 119, withholds the slider 101 itself in the resting position, in which the actuation portion 104 is built-in within the opening 111, and the slider 101, fixed to the slide 119, does not exert any action on the engagement/release mechanisms of the chin guard 110.

In said resting (or inoperative) position, the bottom end of the portion 104 rests on a bottom edge of the opening 111, and the rear projection 115 rests on a top wall of the support 120, fixed to the chin guard 110, so that translation of the slider 101 will be prevented by said supports.

For displacement in translation of the slider 101, in order to actuate the devices for engagement/release of the chin guard 110 it is consequently first necessary to rotate the slider 101, overcoming the resistance exerted by the spring 112, about the pin 113 (as indicated by the arrow C) and thus to obtain the consequent expulsion of the actuation portion 104 from the opening 111 and disengagement of the projection 115 from the top wall of the support 120, so as to enable possible subsequent translation in the direction and sense indicated by the arrow B of the slider 101, or else of the slide 119, with respect to the chin guard 110.

The safety lever 106 comprises an arrest 116, located at one end of an arm 118 of the lever 106 itself, and an actuation arm 107 located in opposition, with respect to the fulcrum of the lever 106 itself, to the arrest 116. The fulcrum of the safety lever 106 consists of a pin 108, which is constrained to the support 120 fixed to the chin guard 110. A contrast spring 109, extending between the chin guard 110 and the arm 107, moreover withholds, in the absence of external forces acting on the arm 107 itself, the lever 106 in a position of support for the arrest 116 on the projection 114 of the slider 101. In this supporting position of the lever 106 on the slider 101, the arrest 116 constitutes a further constraint to sliding of the latter.

The actuation arm 107 of the safety lever 106 moreover extends advantageously inside the chin guard 110 and is protected against any accidental impact by a shaped projection 121, which likewise constitutes a gripping area for raising the chin guard itself 110.

The rotation of the lever 106 about its pin 108, obtained by overcoming the resistance exerted by the spring 109, causes departure of the arrest 116 from the front projection 114, which is thus no longer resting on the arrest 116, and the cam-like coupling of the arm 118 with the pin 117, which causes rotation of the slider 101 about its pin 113 and the consequent expulsion of the actuation portion 104 from the opening 111 of the chin guard 110.

In said position of the safety lever 106, translation in the sense indicated by the arrow B of the slider 101 causes, at a given point of the translation path of the slider, resting of the projection 115 of the slider 101 on the arrest 116 of the lever 106 so that said resting position may constitute an end-of-travel arrest for the slider 101.

In the absence of external forces acting on the lever 106 and/or on the slider 101, the contrast springs 109 and 112 withhold, respectively, the safety lever 106 in the position of engagement of the arrest 116 with the supporting projection 114, and the slider 101 in the inoperative position with respect to the engagement/release mechanisms, where the portion 104 is set inside the opening 111, as may be seen in FIG. 5.

For actuation of the engagement/release mechanisms to enable rotation of the chin guard 110 from the cap of the crash helmet, the user, starting from the position of engagement of FIG. 5, must thus actuate the safety lever 106 by acting on the arm 107 in the direction and sense indicated by the arrow A in order to counteract the spring 109 so as to rotate said lever about its pin 108 and thus simultaneously cause the projection 114 of the slider 101 no longer to rest on the arrest 116 and induce a rotation of the slider 101 about its pin 113, thanks to the cam-like coupling between the curved lateral surface of the arm 118 of the lever 106 and the pin 117 of the slider 101.

Rotation of the slider 101 with respect to the pin 113 in the direction and sense indicated by the arrow C (FIG. 6) causes expulsion of the actuation portion 104 from the opening 111 of the chin guard 110 and disengagement of the rear projection 115 from the top edge of the support 120, so enabling the user to exert a force, having direction and sense indicated by the arrow B, sufficient to translate the slider 101 and the slide 119 downwards so as to obtain release of the chin guard 110 from the cap of the helmet as a result of the tensile force exerted by the tie rods which connect the cap to the engagement/release mechanisms.

The end of the travel of translation of the slider 101 (as may be seen in FIG. 7) is provided both by the contrast of parts between the bottom edge of the opening 111 and the actuation portion 104 and by the resting of the rear projection 115 on the arrest 116 when the safety lever 106 is withheld by the user in a position of release and expulsion of the portion 104 itself.

The displacements A of the safety lever 106 and B of the slider 101, in the aforesaid correct succession, may for example be made, respectively, with the thumb and forefinger of just one hand.

After obtaining, as described above, release of the chin guard 110 with respect to the cap, the user can then raise the chin guard 110 by imposing a rotation on the latter, preferably via the gripping area 121 and again his thumb, which is already engaged for maintaining the displacement A. It follows that release of the chin guard and rotation thereof for tilting it back are simple, practical and ergonomic.

Release of the arm 107 and of the slider 101 by the user, thanks to the return springs 112 and 109, enables the device described herein to be brought back into the initial position represented in FIG. 5.

The structure of the device shown in FIGS. 5 to 7, in addition to rendering rotation of the safety lever 106 or of the slider 101 very difficult on account of the different interposition of shaped parts provided and of the contrast springs 109, 112, is such that neither mere rotation of the lever 106 nor rotation of the slider 101 with respect to its pin 108 can cause release of the chin guard 110 with respect to the cap of the helmet, which is enabled only following upon the additional translation of the slider 101.

Consequently, according to the present invention, for releasing the chin guard 10, 110 with respect to the cap, the user of a crash helmet for motor-cyclists of the type which comprises a rotatable chin guard 10, 110, hinged to the sides of the cap of the helmet, and a releasing device for enabling rotation of the chin guard 10, 110, provided with at least one device 3, 3' for engagement/release of the chin guard to/from the cap, and with first means 1, 2, 2', 5, 101, 112, 113, 119 for actuation of said engagement/release mechanism, as well as with second inhibition means 6, 7, 8, 9, 106, 108, 109 for inhibiting release, in which said first and second means can be actuated by the user and in which the aforesaid second means 6, 7, 8, 9, 106, 108, 109 prevent, when not actuated, operation of the first actuation means 1, 2, 2', 5, 101, 112, 113, 119 and/or of the engagement/release mechanism 3, 3', must follow the steps of:

firstly actuating the aforesaid second inhibition means 6, 7, 8, 9, 106, 108, 109 with the purpose of enabling operation of the first actuation means 1, 2, 2', 5, 101, 112, 113, 119 and/or of the engagement/release mechanism 3, 3';

subsequently actuating the first actuation means 1, 2, 2', 5, 101, 112, 113, 119 of the engagement/release mechanism 3, 3'.

Preferably, actuation of the second inhibition means must be maintained for a time interval sufficient for enabling subsequent actuation of the first means so that the user can perform, only voluntarily and with just one hand, the unique and correct sequence of said operations for releasing and enabling rotation of the chin guard 10, 110, and only subsequently is it possible, once again using the same hand already engaged in keeping actuated the second inhibition means and the first actuation means, for him to rotate the chin guard.

The above method confers on the helmet of the present invention a high degree of practicality and safety of use and at the same time guarantees a lower risk of involuntary or accidental opening of the chin guard occurring both in the case of improper use of the chin guard by the user (for example when the vehicle is moving) and during execution of other manoeuvres frequently performed during use of the helmet, such as opening or closing of the visor, actuation of the ventilation systems present on the chin guard itself, or the mere operations of readjustment/repositioning of the helmet on the user's head.

The invention claimed is:

1. A releasing device for enabling rotation of a chin guard, hinged to the sides of the cap of a crash helmet, in particular for motor-cyclists, of the type which comprises at least one engagement/release mechanism for engagement/release of the chin guard with respect to the cap, first actuation means of said at least one engagement/release mechanism, and second inhibition means for inhibiting release, said first and second means being actuatable by a user, said device being characterized in that said second means prevent, when not actuated by the user, operation of said first actuation means and/or of said at least one engagement/release mechanism.

2. The device according to claim 1, characterized in that said first means comprise at least one control element, which can move between a position of actuation of said at least one engagement/release mechanism and an inoperative position with respect to said engagement/release mechanism, and in that said second means prevent, when not actuated by the user, displacement of said control element from said inoperative position to said position of actuation of the engagement/release mechanism.

3. The device according to claim 1, characterized in that said second inhibition means comprise at least one removable arrest, which engages, by interposition of parts, said first actuation means and/or said engagement/release mechanism.

4. The device according to claim 2, characterized in that said arrest can move between a position of engagement with said control element and a position of disengagement from the latter.

5. The device according to claim 3, characterized in that said second inhibition means comprise a two-armed lever, one of the two arms being equipped with, or coinciding with, said arrest.

6. The device according to claim 5, in which said lever is mounted elastically on said chin guard or on said cap.

7. The device according to claim 1, characterized in that said first actuation means are equipped with at least one control element consisting of a slider translatable along a given path (B).

8. The device according to claim 7, characterized in that said slider is slidably mounted on said chin guard or on said cap.

9. The device according to claim 7, characterized in that said slider is mounted on said chin guard or on said cap in a rotatable way.

10. The device according to claim 8, in which said inhibition means, when not actuated by the user, prevent rotation and/or translation of said slider.

11. The device according to claim 7, in which there are present two engagement/release mechanisms set in positions corresponding to the opposite sides of the cap and which is characterized in that said control element is single and is set on the chin guard in a central position and/or outside the latter.

12. The device according to claim 7, in which said slider is mounted on said chin guard and is rotatable between a position projecting outside said chin guard and a position flush therewith.

13. The device according to claim 12, in which said slider is withheld elastically in said position flush with the chin guard.

14. The device according to claim 12, in which said inhibition means, when not actuated by the user, prevent translation and/or rotation of said slider.

15. The device according to claim 1, characterized in that said first actuation means comprise at least one tie rod for connection between a mobile control element and said at least one engagement/release mechanism.

16. The device according to claim 1, characterized in that said first means for actuation of said engagement/release mechanism can be actuated by the user according to a direction (B), which is incident with respect to the direction of actuation (A) of said second inhibition means.

17. The device according to claim 1, characterized in that said first actuation means can be actuated by the user in a sense opposite, at least with respect to one direction, to the sense of actuation of said second inhibition means.

18. A crash helmet for motor-cyclists of the type which comprises a rotatable chin guard hinged to the sides of the cap of the helmet, characterized in that it comprises a releasing device for enabling rotation of said chin guard according to claim 1.

19. A method for releasing and enabling rotation of a chin guard hinged to the sides of the cap of a crash helmet, in particular a helmet for motor-cyclists, and constrained thereto by means of at least one mechanism for engagement/release for disabling/enabling rotation of the chin guard with respect to the cap, said helmet comprising first means for actuation of said engagement/release mechanism and second means for inhibition of release, said first and second means being actuatable by a user and said second means preventing, when not actuated by the user, operation of said first actuation means and/or of said at least one engagement/release mechanism, said method being characterized by the steps of:

actuating first said second inhibition means for enabling the operation of said first actuation means and/or of said at least one engagement/release mechanism; and then actuating said first means for actuation of the engagement/release mechanism.

20. The method according to claim 19, characterized in that said step of actuating said first means for actuation of the engagement/release mechanism takes place whilst said second inhibition means continue to be actuated.

* * * * *